US005129251A

United States Patent [19]

Takikawa

[11] Patent Number: 5,129,251

[45] Date of Patent: Jul. 14, 1992

[54] MANUFACTURING PROCESS FOR END FITTING FOR EYE JOINT

[75] Inventor: Kazunori Takikawa, Numazu, Japan

[73] Assignee: Usui Kokusai Sangyo Kaisha Ltd., Japan

[21] Appl. No.: 409,257

[22] Filed: Sep. 19, 1989

Related U.S. Application Data

[63] Continuation of Ser. No. 230,058, Aug. 9, 1988, abandoned.

[30] Foreign Application Priority Data

Aug. 14, 1987 [JP] Japan ..... 62-202883

[51] Int. Cl.[5] ..... B21C 23/00

[52] U.S. Cl. ..... 72/334; 72/356

[58] Field of Search ..... 72/356, 377, 334, 267; 83/54; 29/898

[56] References Cited

U.S. PATENT DOCUMENTS 2,265,839 12/1941 Hufferd et al. .
2,344,803 3/1944 Criley ..... 72/356 X
2,748,932 6/1956 Kaul ..... 72/356 X
3,584,373 6/1971 Schane .
3,818,746 6/1974 Fujita .

FOREIGN PATENT DOCUMENTS 2384567 10/1978 France .
56-50743 5/1981 Japan .
59-225843 12/1984 Japan .

*Primary Examiner*—Joseph M. Gorski
*Attorney, Agent, or Firm*—Anthony J. Casella; Gerald E. Hespos

[57] ABSTRACT

An end fitting for eye joint is manufactured in the form of half-finished product first through a series of cold forging coming in pressing or drawing, punching and rearward extrusion of a short metallic cylindrical material, and then a finished product is obtained through cutting process applied thereto. For the half-finished product to obtain first, cutting process is not particularly required.

2 Claims, 2 Drawing Sheets

PRIOR Fig.3(C)
PRIOR ART

MANUFACTURING PROCESS FOR END FITTING FOR EYE JOINT

This application is a continuation application of Ser. No. 230,058 which was filed on Aug. 9, 1988 and now abandoned.

BACKGROUND OF THE INVENTION

1. Field of the Invention

This invention relates to a manufacturing process for end fitting for eye joint fixed on a connection of metallic conduit, resin tube or the like relatively small in bore at 30 mm or below which is disposed and so used as feed passage for fuel, oil, air and so forth generally on automobiles or various types of machinery and apparatuses.

2. Description of the Prior Art

As illustrated by a manufacturing process in FIG. 3 (A) to (E), for example, a prior art process for such end fitting comprises forming a spherical head (12) on another end side of a cylindrical piece (11) cut to a necessary length through forging, drilling then a connection hole (13) therein on its one end side, forming next a flat plane (14) on one side of a peripheral surface of the head (12) through cutting and drilling a bolt hole (15) in the head orthogonally to the flat plane, further providing a flat plane (14') on a peripheral surface opposite to the flat plane (14) through cutting again, cutting and forming an annular recess groove (16) communicating with the connection hole (13) within the bolt hole (15) by means of a boring bar tool, and then deburring the cutting planes.

Further, that of using a bar material otherwise is known as disclosed in Japanese Patent Laid-Open No. 225843/1984. That is, a process for semimanufactured end fitting for eye joint proposed thereby comprises forming a metallic cylindrical piece into a hollow caplike member through punching, forming a head of the caplike member into a convexity through punching in the next stage, inserting a tube forming pin from an opening of the hollow caplike member and forming a tapered portion halfway of the hollow cap-like member, then forming the hollow caplike member into a spherical portion and a tubular portion having a small diametral part and a large diametral part by means of a punching die and a stepped pin.

However, in such prior art manufacturing process, since the process almost comprises cutting in the former, not only much time is required therefor to deteriorate considerably the productivity, but also a wastefulness is incurred on the material to cause a high manufacturing cost, and in the latter a series of forming covering another stage may involve a complexity of the equipment, and further a series of forming accompanying a plastic deformation due to a deep drawing at the hollow caplike member portion may inevitably lay down restrictions on use of the material, and thus a scope of application is limited accordingly.

SUMMARY OF THE INVENTION

In order to remove the aforementioned problem effectively, an object of ,the invention is to provide a manufacturing process for forming a half-finished product with a connection cylindrical body formed integrally on a spherical head from a cylindrical material through a series of cold forging, and then obtaining a finished product through cutting, whereby cutting before forming the aforementioned half-finished product is not required to enhancement of productivity, a wastefulness of the material is removed at the same time, further a low manufacturing cost is realized by the equipment relatively small in scale and the simple process, and moreover, a scope of application of the working material can be expanded.

A gist of the invention is to provide a manufacturing process for end fitting for eye joint, comprising a process for forming a metallic cylindrical material into a small diametral wall part on one end side and a large diametral wall part on the other end side, a process for forming an almost spherical head by retaining the small diametral side on a die body having a curved recess in front and pressing the large diametral wall part on the other end side by means of a punch from an outside top mounted coaxially, and also for providing a centering recess groove by a punching pin to a shaft center portion on a nose of the small diametral wall part, a process for forming a connection hole by a separate punching pin according to a rearward extrusion at the recess groove, thereby forming a half-finished product with a connection cylindrical part formed integrally on the spherical head, and a process for cutting flat planes parallel with each other on a peripheral side opposite to the head, a bolt hole passing through a shaft center of the flat planes, and an annular recess groove communicating with the connection hole on a peripheral surface in the bolt hole.

Since the invention comprises the aforementioned manufacturing process, a state of half-finished product as an eye joint end fitting with the spherical head and the connection cylindrical part formed integrally therefor is obtainable through a series of forming process for the large diametral wall part formed by pressing a metallic cylindrical material on one end side according to a cold forging, the small diametral wall part through drawing, the head through punching and the connection hole through rearward extrusion. Further, according to a construction of the small diametral wall part through deep drawing, a metallic structure at the connection cylindrical part formed of the small diametral wall part is tightened to increase stiffness as a result, and hence a thin wall is still enough to enhance a mechanical strength against external shock or vibration. Still further, in advance to press forming of the head, a preliminary working of the circular truncated cone will be applied as desired, which may facilitate forming of the head thereafter reasonably and concentrically.

DETAILED DESCRIPTION OF PREFERRED EMBODIMENT

Figure 1:
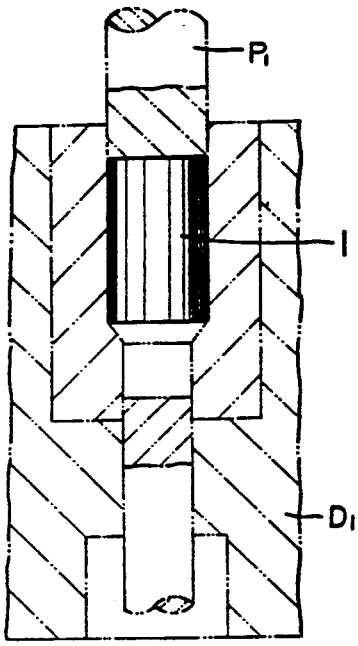
FIG. 1 (A) to (E) are sectional explanatory drawings representing a working state successive before obtaining a half-finished product through a cold forging relating to a manufacturing process for end fitting for eye joint which is given in one embodiment of the invention.
Figure 1:
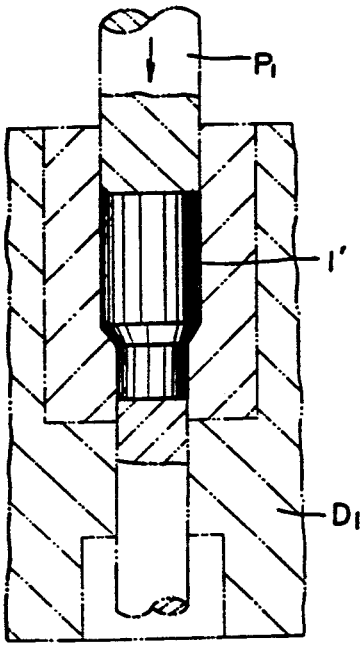
Figure 1:
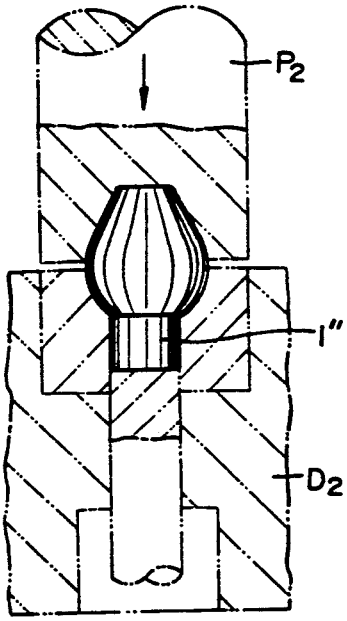
Figure 1:
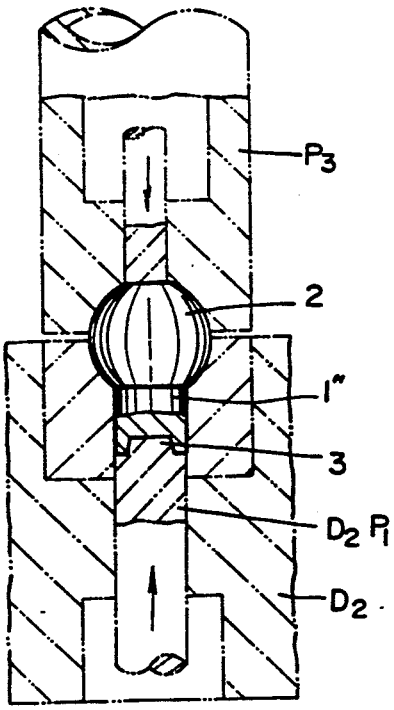
Figure 1:
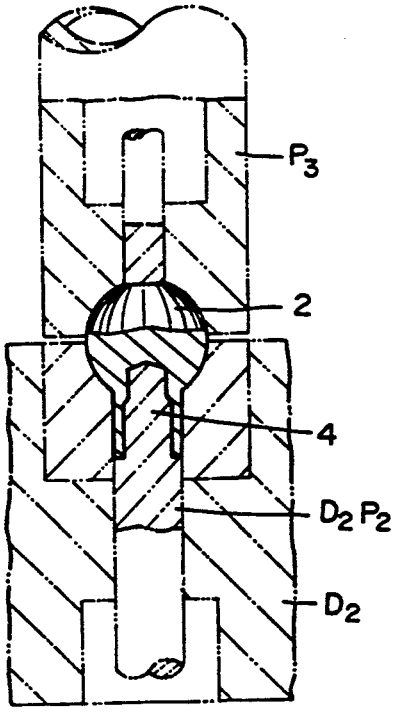
Figure 2A:
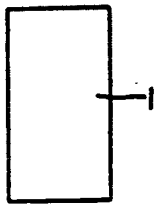
FIG. 2 (A) to (G) are drawings illustrative of processes for obtaining a finished product including the half-finished product formed according to the process of FIG. 1.
Figure 2B:
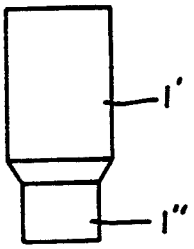
Figure 2C:
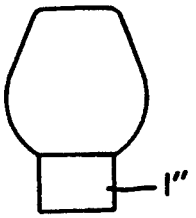
Figure 2D:
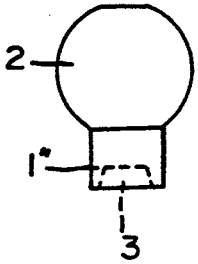
Figure 2E:
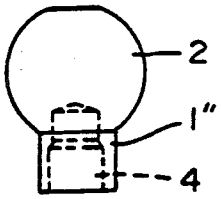
Figure 2F:
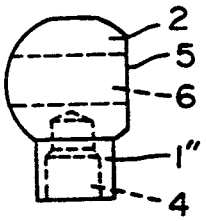
Figure 2G:
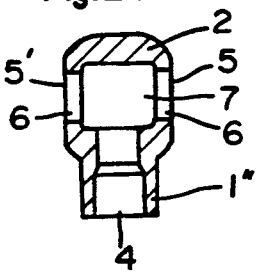
Figure 3A:
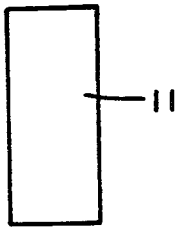
Fig.3(A) PRIOR ART
FIG. 3 (A) to (E) are drawings illustrative of a product formed according to a prior art manufacturing process.
Figure 3B:
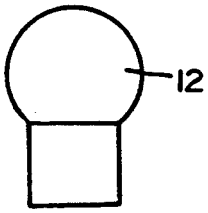
Fig.3(B) PRIOR ART
Figure 3B:
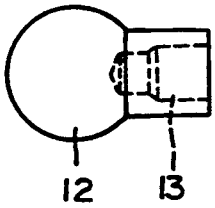
Fig.3(B) PRIOR ART
Figure 3D:
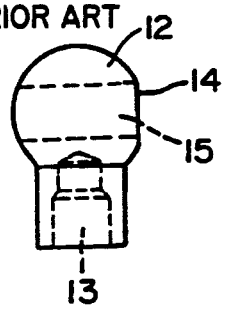
Fig.3(D) PRIOR ART
Figure 3E:
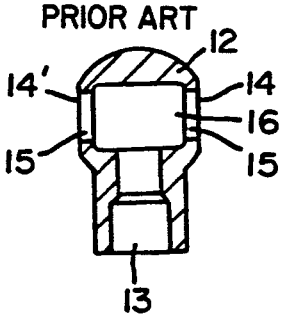
Fig.3(E) PRIOR ART

In FIG. 1 and FIG. 2, (1) denotes a short metallic cylindrical material (FIG. 2 A) cut to a necessary length beforehand, which is provided with a small diametral wall part (1") (FIG. 1 B) on its one end side through a cold drawing in the direction of shaft center on a punch ($P_1$) with the cylindrical material set (FIG. 1 A) within a die body ($D_1$) in which a carbide die member is buried. Next, with or without a preliminary process (FIG. 1 C) wherein the small diametral wall part (1") side is retained on a separate die body ($D_2$) having a curved recess in front, a large diametral wall part side on the other end is pressed on a punch ($P_2$) from an outside top mounted coaxially, thereby forming into a circular truncated cone ranging to a hemispherical swelling wall part on the lower half portion, an almost spherical head (2) is formed on a punch ($P_3$), and a centering recess groove (3) by a punch ($D_2P_1$) to a bottom wall shaft center part of the small diametral wall part (1") is provided (FIG. 1 D). Further in such state, a connection hole (4) (FIG. 1 E) is formed on the centering recess groove on a separate punch ($D_2P_2$) according to a rearward extrusion, thus forming a half-finished product as an end fitting for eye joint with the spherical head (2) and the connection cylindrical part formed integrally. Next, a flat plane (5) (FIG. 2 F) is provided on one side of a peripheral side of the spherical head (2) obtained through the above-described process through cutting and a bolt hole (6) is cut and formed orthogonally through shaft center parts of the flat planes (5, 5'), a working is applied to the flat plane (5') parallel with a peripheral side opposite to the flat plane (5), and further an annular recess groove (7) (FIG. 2 G) communicating with the connection hole (4) is formed on a peripheral surface within the bolt hole (6) by means of a boring bar tool.

As described above, according to the manufacturing process for end fitting for eye joint relating to the invention, the half-finished product is obtained through a series of cold forging coming in pressing or drawing, punching and rearward extrusion, therefore cutting process is not required therefor to enhance productivity, a wastefulness of the material can be avoided, further a low manufacturing cost is realizable from the equipment relatively small in scale and the simple working process, then since a deep drawing is not required, a scope of application of the working bar material will be expanded, and working hours can sharply be reduced in conjunction with a forming of the connection hole (4) through rearward extrusion, thus providing a serviceable manufacturing process for end fitting for eye joint.

What is claimed is:

1. A process for manufacturing an end fitting for an eye joint having a generally spherical head with a transverse bolt hole extending therethrough, and having a cylindrical portion of a specified length extending from the head, with a connection hole extending axially through the cylindrical portion and into communication with the bolt hole, said process comprising the steps of:

providing a solid metal cylindrical member having opposed rearward and forward ends and having a longitudinal axis and a substantially uniform initial diameter along said longitudinal axis;

cold drawing said member to define a reduced diameter cylindrical portion adjacent said rearward end defining a length less than the specified length;

forming said forward end of said member to define the generally spherical head for the eye joint adjacent said forward end of said member;

punch forming a centering recess in the rearward end of said member;

punch forming a connection hole in the cylindrical portion aligned with but extending deeper than the centering recess without removing metal material from the member, such that the punch forming of the connection hole extrudes the cylindrical portion rearwardly to the specified length, said punch formed connection hole extending centrally substantially the entire length of said reduced diameter cylindrical portion;

cutting said generally spherical head to define at least one planar surface extending substantially parallel to the longitudinal axis of said member;

boring a bolt hole perpendicular to the planar surface; and forming an annular recess groove within said bolt hole, said annular recess groove being dimensioned to provide communication between the punch formed connection hole and the bored bolt hole.

2. A process as in claim 1 wherein the step of forming the generally spherical head comprises the steps of forming a first generally semispherical portion adjacent the reduced diameter cylindrical portion and a generally truncated cone adjacent said forward end, and further forming the truncated cone to define a second generally semispherical portion extending continuously from the first generally semispherical portion to define the generally spherical head.

* * * * *